US006794622B1

(12) United States Patent
Alveberg et al.

(10) Patent No.: US 6,794,622 B1
(45) Date of Patent: Sep. 21, 2004

(54) DEVICE AND METHOD FOR REMOVAL OF RUST AND PAINT

(75) Inventors: Bjorn Erik Alveberg, Oslo (NO); Tom Arne Baann, Stathelle (NO)

(73) Assignee: Jak. J. Alveberg AS, Osteras (NO)

( * ) Notice: Subject to any disclaimer, the term of this patent is extended or adjusted under 35 U.S.C. 154(b) by 126 days.

(21) Appl. No.: 10/129,283

(22) PCT Filed: Nov. 1, 2000

(86) PCT No.: PCT/NO00/00363

§ 371 (c)(1),
(2), (4) Date: Jun. 27, 2002

(87) PCT Pub. No.: WO01/32443

PCT Pub. Date: May 10, 2001

(30) Foreign Application Priority Data

Nov. 2, 1999 (NO) ..... 19995353

(51) Int. Cl.[7] ..... H05B 6/08; H05B 6/14

(52) U.S. Cl. ..... 219/635; 219/645; 219/653; 219/663; 219/665; 134/17

(58) Field of Search ..... 219/635, 645, 219/653, 665, 663; 134/17, 38

(56) References Cited

U.S. PATENT DOCUMENTS

| | | | | |
|---|---|---|---|---|
| 3,743,808 A | * | 7/1973 | Kasper | 219/650 |
| 5,617,800 A | | 4/1997 | Moreschi et al. | |
| 5,660,753 A | * | 8/1997 | Lingnau | 219/635 |
| 5,938,965 A | | 8/1999 | Madeira | |

FOREIGN PATENT DOCUMENTS

| | | |
|---|---|---|
| DE | 2600135 | 7/1977 |

* cited by examiner

*Primary Examiner*—Philip H. Leung
(74) *Attorney, Agent, or Firm*—Ladas & Parry

(57) ABSTRACT

A method and a device for the removal of rust and paint from a metal surface, wherein induction heat is used for heating the metal surface. The device includes an electrical power supply coupled to an induction coil. A wheel and a tachometer on the device measure the velocity of the device as the wheel rotates on the metal surface. A control unit regulates the power output of the electrical power supply based upon the measured velocity of the device.

9 Claims, 1 Drawing Sheet

DEVICE AND METHOD FOR REMOVAL OF RUST AND PAINT

BACKGROUND OF THE INVENTION

Figure 1:
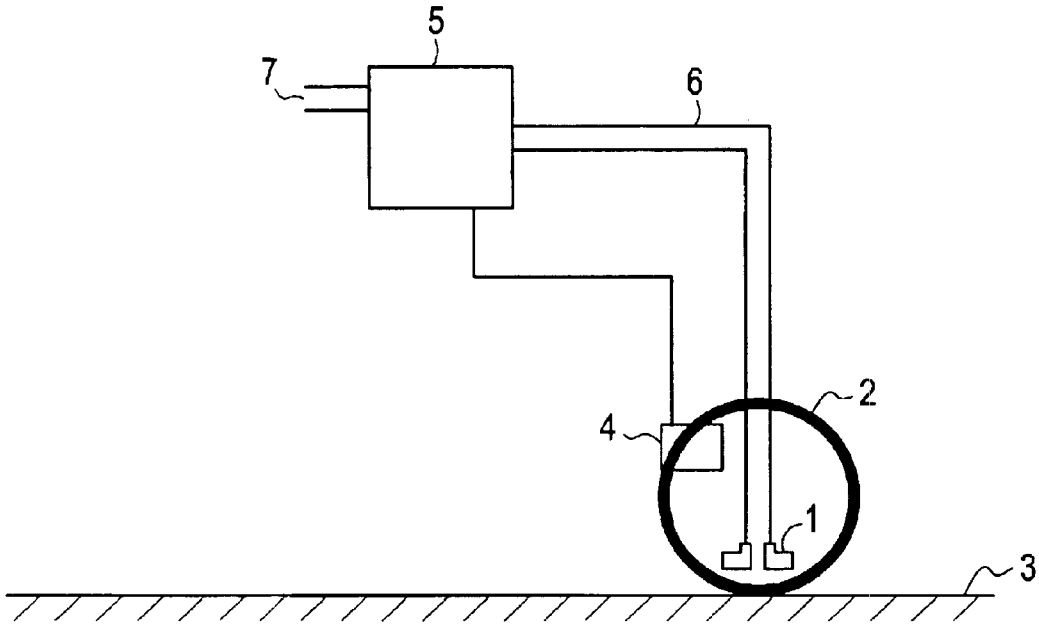

The present invention relates to a device and method for removal of rust and paint from a metal surface.

DESCRIPTION OF THE RELATED ART

It is estimated that corrosion amounts to 3–4% of the BNP in the western world. Only in Norway millions of square meters are protected by paint each year. In order to achieve good results, the surfaces that are to be painted must be cleaned and pretreated. In industrial applications this is usually done by sandblasting, grinding or jet water washing. Combinations of these methods are also used.

The most frequently used method is sandblasting. Old paint and rust is removed by a blasting the surface with sand or other suitable agents. This is a costly and quite time-consuming process. The advantage of this method is that the blasting process creates a rough surface that gives a good adhesion for new paint. Furthermore, the used equipment is cheap, simple to operate and easy to maintain. The disadvantages with this method is that large quantities of sand are used, which generates a lot of dust, the equipment is heavy and awkward to handle, the method is slow and does not remove grease and other foulings such as water soluble salts, sulfates etc.

Jet water washing is a paint and rust removal method that has become more usual. The advantages of this method are that dust related problems are avoided, there is less waste, and water-soluble foulings are removed. The disadvantages of this method are that the equipment is expensive and difficult to maintain, no roughness is made on the steel surface, a lot of water is spilled, large quantities of water is required (which is a problem on e.g. a ship), and the treated surface must be dried before it can be painted.

Grinding is a method that no longer often is used. The method is mainly used for patchwise repairs.

Most often, the paint is mainly intact on the surface that is to be cleaned. Optimally, the paint only has to be removed, because the roughness on the steel surface is intact. An example is power plants, where the piping is sandblasted even if 95% of the existing paint is intact. The situation is the same in offshore applications.

There are increasing numbers of restrictions on sandblasting and alternative methods have continually been attempted without success.

The present invention aims at avoiding the aforementioned disadvantages, while providing a method and a device that more effectively removes paint and rust.

Further advantages and preferred embodiments are mentioned in the independent claims and in the specification under reference to the enclosed drawing, which shows a preferred embodiment of the present invention.

According to the present invention, rust and old paint is removed by means of induction heat. In addition, grease and other foulings are removed from the surface. This is a quick and reliable method that does not produce excessive waste.

Induction heat is created in magnetic metals by means of magnetic fields. This is a known principle and is used for heating steel in bending and punching processes, and in welding of steel and pipes, e.g. in connection with production of body details in the car industry.

By induction heating the steel to 250–300° C., the steel is heated without heating the rust and paint. The steel will expand and attached rust will peel of due to the much lower expansion coefficient of rust as compared to steel. The paint will peel of as a result of the heated surface.

DETAILED DESCRIPTION OF THE PREFERRED EMBODIMENT

Equipment for generating induction heat is known per se, and heating of steel by means of induction heating has been utilized for a number of years. However, the use of induction heat for removal of rust and paint is not known in the prior art.

It is of utmost importance that the steel 3 is not overheated. The provided heat has to be constant even if the speed of an induction coil 1 over the steel 3 varies. According to the present invention, the quantity of energy deposited in the steel 3 is varied according to the velocity of the induction coil 1 over the steel surface 3. This ensures a constant temperature profile in the steel 3. Furthermore, according to the present invention, this is achieved by means of arranging the induction coil 1 in a frame with a wheel 2. The wheel 2 is rolled over the steel surface, and the velocity of the wheel regulates the quantity of provided energy. The slower the wheel 2 rotates, the less energy is provided to the coil. If the rotational speed increases, the supplied energy increases. In short, the quantity of energy pr. unit area of steel 3 is equal for one revolution, independent of the rotational speed.

The frequency (hertz) of the AC-current supplied to the induction coil 1 determines the depth of the magnetic field in the steel 3. The frequency (and thereby the depth) can be determined from the induction device according to the present invention. By controlling the current, that is the supplied kW, and simultaneously controlling the frequency, the desired temperature is obtained in a desired layer of the steel 3.

About 90% of the supplied energy is used in the heating process. This means that the energy conversion loss is small compared to conventional methods for heating of steel. In the past, gas torches have been used for removing rust and oxide scale from steel surfaces. This process was effective, but because only 5–10% of the supplied energy was converted to heat and because the heat from the gas torch had to penetrate rust and other covering layers, this process became expensive compared to other methods such as sandblasting etc.

When using induction heating according to the present invention, only a layer of the steel, for example 0.5 mm, is heated for a limited time period, and the steel will rapidly cool dawn by heat propagation, thereby avoiding that loosened paint "burns" to the surface. This also entails that heat does not propagate through the other side of steel with a thickness above about 3 mm, thereby avoiding damage to possible paint on said other side.

By removal of paint by means of induction heating it is important that the temperature in the steel is controlled. If use is made of "handheld" equipment without it's own drive mechanism, a power supply varying the supplied current according to the surface velocity of the induction coil 1 is needed.

According to the present invention this is achieved in the following manner:

The induction coil 1 indirectly supplying heat to the steel 3 is supported on a freely running wheel 2 that ensures a specific distance from the coil 1 to the steel 3. The wheel 2 is connected to a tachometer 4, which feeds signals to a voltage regulator 5 in a transformer unit (not shown). This insures that the supplied voltage is increased if the velocity increases and that more energy is supplied per unit time, at the same time as the deposited energy per unit area is the same, independent of the velocity.

The control unit 5 may comprise a standard PLS such as an impedance regulator, thyristor or triac. The preferred kind of PLS depends on the application and preferred function. Alternatively, a combination of the aforementioned PLSs may be used, opening up the possibility for different functional modes.

The tachometer 4 may be of the stroboscope kind or any other revolution counter that can feed signals to a PLS control unit 5.

The distance between the induction coil 1 and the surface 3 may be adjusted in addition to frequency, current strength etc. The induction coil is arranged in relation to the wheel 2 such that a certain distance, that well may be adjustable, is kept.

The frequency and current strength of the induction coil 1 may be adjusted manually or automatically by means of the control unit 5, in order to obtain the desired temperature and temperature profile (e.g. the depth of a layer with a specific temperature) in the metal surface.

An essential feature of this process is the supplied energy to the steel 3. This energy has to be constant; otherwise it will effect the quality of the work. If the supplied energy is too small, the steel 3 will not achieve a high enough temperature for paint and rust to loosen. If the supplied energy is too great, the paint on the other side of the steel may be damaged, and the loosened paint may "burn" to the surface.

In automatic embodiments this process may be developed to achieve optimal rates for removal of rust and old paint. Theoretic rates may be converged and the conversion efficiency for the supplied energy may reach 90%.

The present invention, in combination with sandblasting only when there is a need for a rough surface and jet water washing for removal of water soluble foulings, is a very attractive alternative to prior art solutions. In addition, this method also kills bacteria and other organisms that have proven to promote corrosion.

It is understood that a person skilled in the art, when reading this specification under reference to the attached drawings, may conceive of modifications or alternatives that fall within the scope and idea of the present invention as defined in the following claims.

What is claimed is:

1. An apparatus for the removal of rust and paint from a metal surface by means of induction heat, the apparatus comprising:

an electrical power supply means;

an induction coil coupled to the power supply means;

a wheel which rotates on the metal surface as the apparatus is moved over the metal surface;

a tachometer which measures the amount of rotation of the wheel over time, and thus measures the velocity of the apparatus over the metal surface; and a control unit to regulate the power output of the electrical power supply means;

wherein said control unit receives rotational measurement signals from said tachometer and regulates the power output of the electrical supply means by increasing the power output as the velocity of the apparatus over the metal surface increases, and decreasing the power output as the velocity of the apparatus over the metal surface decreases.

2. The apparatus according to claim 1, wherein the frequency and current strength of the induction coil is adjusted manually by means of the control unit in order to achieve a predetermined temperature and temperature profile in the metal surface.

3. The apparatus according to claim 1, wherein the frequency and current strength of the induction coil is adjusted automatically by means of the control unit in order to achieve a predetermined temperature profile in the metal surface.

4. The apparatus of claim 1, wherein said tachometer is a stroboscope tachometer.

5. The apparatus of claim 1, wherein the position of the induction coil within the apparatus is adjustable relative to the metal surface.

6. A method for the removal of rust and paint from a metal surface comprising the steps of:

providing an induction heating apparatus comprising:

an electrical power supply means;

an induction coil coupled to the power supply means;

a wheel which rotates on the metal surface as the apparatus is moved over the metal surface;

a tachometer which measures the amount of rotation of the wheel over time, and thus measures the velocity of the apparatus over the metal surface; and a control unit to regulate the power output of the electrical power supply means;

supplying rotational measurement signals from said tachometer to said control unit; and regulating the power output of the electrical supply means by increasing the power output as the velocity of the apparatus over the metal surface increases, and decreasing the power output as the velocity of the apparatus over the metal surface decreases.

7. The method of claim 6 further comprising the step of manually adjusting the frequency and current strength of the induction coil by means of the control unit in order to achieve a predetermined temperature and temperature profile in the metal surface.

8. The method of claim 6 further comprising the step of automatically adjusting the frequency and current strength of the induction coil by means of the control unit in order to achieve a predetermined temperature and temperature profile in the metal surface.

9. The method of claim 6 further comprising the step of adjusting the position of the induction coil within the apparatus relative to the metal surface.

* * * * *